US005829065A

United States Patent [19]

Cahill

[11] Patent Number: 5,829,065

[45] Date of Patent: Nov. 3, 1998

[54] INDUSTRIAL PROTECTIVE HELMET

[76] Inventor: Kevin J. Cahill, 650 Reservoir Dr., Weare, N.H. 03281

[21] Appl. No.: 669,608

[22] Filed: Jun. 24, 1996

Related U.S. Application Data

[63] Continuation-in-part of Ser. No. 196,426, Feb. 15, 1994, abandoned.

[51] Int. Cl.[6] ..... A42B 3/08

[52] U.S. Cl. ..... 2/418; 2/421

[58] Field of Search ..... 2/410, 411, 412, 2/414, 415, 418, 421, 422, 425, 15, 10, 209.13, 209.14, 424, 8, 417; 206/214, 224, 443

[56] References Cited

U.S. PATENT DOCUMENTS

| | | | |
|---|---|---|---|
| 1,586,701 | 6/1926 | Reppa . | |
| 1,652,776 | 12/1927 | Galanis . | |
| 1,819,225 | 5/1931 | Burman . | |
| 2,706,294 | 4/1955 | Sprinkle . | |
| 3,155,981 | 11/1964 | McKissick et al. | 2/422 |
| 3,315,273 | 4/1967 | Bullard . | |
| 3,365,725 | 1/1968 | Webb . | |
| 3,457,563 | 7/1969 | Marchello . | |
| 3,551,044 | 12/1970 | Weile . | |
| 3,582,990 | 6/1971 | Frieder . | |
| 3,720,955 | 3/1973 | Rawlings . | |
| 3,852,821 | 12/1974 | Mickel | 2/421 |
| 3,925,821 | 12/1975 | Lewicki | 2/425 |
| 3,935,044 | 1/1976 | Daly . | |
| 3,994,020 | 11/1976 | Villari . | |
| 4,024,586 | 5/1977 | Lamb . | |
| 4,091,469 | 5/1978 | Davidson . | |
| 4,263,679 | 4/1981 | Erlendson . | |
| 4,434,514 | 3/1984 | Sundahl et al. | 2/425 |
| 4,653,123 | 3/1987 | Broersma | 2/425 |
| 4,869,586 | 9/1989 | Chung . | |
| 4,947,488 | 8/1990 | Ashinoff . | |
| 5,010,598 | 4/1991 | Flynn et al. | 2/410 |
| 5,035,009 | 7/1991 | Wingo, Jr. et al. . | |
| 5,044,016 | 9/1991 | Coombs . | |
| 5,044,019 | 9/1991 | Shewchenko et al. . | |
| 5,088,130 | 2/1992 | Chiarella . | |
| 5,093,937 | 3/1992 | Kamata . | |
| 5,136,728 | 8/1992 | Kamata . | |
| 5,177,810 | 1/1993 | Minton et al. . | |
| 5,212,843 | 5/1993 | Kamata . | |
| 5,253,368 | 10/1993 | Blake | 2/209.13 |
| 5,272,773 | 12/1993 | Kamata | 2/421 |
| 5,345,614 | 9/1994 | Tanaka . | |
| 5,381,560 | 1/1995 | Halstead | 2/421 |
| 5,551,094 | 9/1996 | Navone | 2/421 |
| 5,581,819 | 12/1996 | Garneau | 2/421 |
| 5,638,551 | 6/1997 | Lallemand | 2/421 |
| 5,659,900 | 8/1997 | Arney et al. | 2/417 |

FOREIGN PATENT DOCUMENTS

| | | |
|---|---|---|
| 2 508 777 | 1/1983 | France . |
| 2508777 | 1/1983 | France . |
| 3619282 | 12/1987 | Germany . |
| 95/01739 | 1/1995 | WIPO . |

*Primary Examiner*—Michael A. Neas
*Attorney, Agent, or Firm*—Hayes, Soloway, Hennessey, Grossman & Hage, P.C.

[57] ABSTRACT

An industrial protective helmet has a rigid outer shell extending upon a surface region of a wearer's head, including temple and skull base regions, a liner of rigid foam fixedly attached to an inner surface of the rigid shell, and one or more selectively-positioned, fit-adjustment elements of compressible foam material engaged upon an exposed surface of the liner with an opposite surface positioned for cushioning engagement with the wearer's head. The helmet may also include one or more of a resilient strap extending about the rear of the head, an adjustable transparent peak, a removable sweat band, a chin strap and/or a fabric cover.

52 Claims, 8 Drawing Sheets

INDUSTRIAL PROTECTIVE HELMET

BACKGROUND OF THE INVENTION

This application is a continuation-in-part of U.S. Ser. No. 08/196,426, filed Feb. 15, 1994, now abandoned.

The invention relates to industrial protective headwear, i.e., safety helmets for use in construction, manufacturing, or other industrial applications, e.g., helmets commonly known as "hardhats".

Use of protective headwear or hardhats on construction sites, as well as in other industrial applications, is mandated in the United States by safety regulations issued by the Occupational Safety and Health Administration ("OSHA"). The performance of these hardhats is prescribed by the American National Standards Institute in ANSI Z89.1-1986; *Protective Headwear for Industrial Workers—Requirements.* However, even after the OSHA regulations have been in effect for many years, the wearing of protective headwear on construction sites is still not universal nor constantly applied, due, at least in part, to the recognized inadequacies of the currently available "industry standard" helmets for reasons of, e.g. comfort, convenience and even safety. For example, the standard nylon strap suspension system is designed only to resist impact from directly above, and it provides virtually no protection against impact from either side, nor from front and back. The head can be subjected to lateral impact on a construction site by moving objects or in the course of a fall. ANSI itself, in the foreword to the current edition, states: "After careful review, Accredited Standards Committee on Industrial Helmets, Z89, decided that the interests of the industrial safety community would be best served by revising ANSI Z89.1-1981 to allow innovation, particularly in retention systems." The standard helmet also provides little protection to a wearer's temples and rear skull-neck junction, areas among the most vulnerable on the human skull. The standard helmet incorporates a peak (defined in ANSI Z89.1-1986 as "an integral part of the shell extending forward over the eyes only") that can block wearer's vision in a critical direction, i.e. above and to the front. In fact, many helmet wearers find their most frequent need for the helmet is to protect against impacts with objects into which the wearer has walked blindly, because the helmet peak obscured an obstruction from view. The standard helmet also has a maddening tendency to slide from the wearer's head with the slightest jostle or inversion. Even when it does stay on a wearer's head, the standard helmet is ungainly and hot enough to inspire many workers to avoid their use when possible.

SUMMARY OF THE INVENTION

According to one aspect of the invention, a industrial protective helmet comprises a rigid outer shell extending upon a surface region of a wearer's head, including temple and skull base regions, a liner of rigid foam fixedly attached to an inner surface of the shell (as allowed by ANSI Z89.1-1986, paragraph 6.3.4), and at least one, selectively-positioned, fit-adjustment element of compressible foam material defining a first surface for engagement upon an exposed surface of the liner and an opposite second surface positioned for cushioning engagement with a surface of the wearer's head. Advantageously, the temple and skull base regions of the helmet provide protection to the temporal and occipital bones of the wearer's skull, and provide protection against impact from the sides, front and rear.

Preferred embodiments of this aspect of the invention may include one or more of the following additional features. The industrial protective helmet further comprises a continuous rear securement strap of resilient material having a first segment passing between the shell and liner in a region over a wearer's forehead and a second, exposed portion extending rearwardly about the base of a wearer's skull. The liner of rigid foam fixedly attached to an inner surface of the shell defines at least one passive cooling channel for passage of ventilation generally between the rigid shell and a head surface of the wearer. The liner of rigid foam may comprise various materials, depending on the location on a wearer's skull being protected. Weight is a critical issue in any helmet design, e.g., ANSI Z89.1-1986 sets a maximum weight of 15.5 ounces; accordingly, preferred helmets have a weight of less than 15.5 ounces. The second surface of the selectively-positioned, fit-adjustment element comprises a wicking material for drawing moisture away from the surface of the wearer's head. The industrial protective helmet further comprises a sweat band removably attached within the rigid shell and having a face surface disposed for engagement upon a surface of the wearer's brow. Preferably, the face surface of the sweat band comprises a wicking material for drawing moisture away from the surface of the wearer's brow. The industrial protective helmet further comprises a peak of transparent material, e.g., clear, tinted or polarized, removably attached upon an outer surface of the rigid shell in a region generally above a wearer's eyes. Preferably, the transparent peak is positioned on the rigid shell. The industrial protective helmet further comprises an optional front securement strap having first and second ends attached to the rigid shell, and extending about a wearer's chin. The industrial protective helmet further comprises a flexible cover, e.g., formed of a resilient material, sized and constructed for snug attachment upon an outer surface of the rigid shell. The flexible cover may preferably be formed of a material selected to resist snagging or grabbing upon an engaging surface during relative movement of the flexible cover along the engaging surface.

According to another aspect of the invention, a industrial protective helmet comprises a rigid outer shell extending upon a surface region of a wearer's head, including temple and skull base regions, a liner of rigid foam fixedly attached to an inner surface of the shell, and a rear securement strap of resilient material having a first segment passing continuously between the rigid shell and liner at a region of a wearer's forehead and a second, exposed portion extending rearwardly about the base of a wearer's skull.

Preferred embodiments of this aspect of the invention may include one or more of the following additional features. The liner of rigid foam fixedly attached to an inner surface of the shell defines at least one passive cooling channel for passage of ventilation generally between the rigid shell and a head surface of the wearer. The industrial protective helmet further comprises a flexible cover sized and constructed for snug attachment upon an outer surface of the rigid shell, the flexible cover defining at least one aperture in registration with a ventilation opening defined in the rigid shell. The industrial protective helmet further comprises at least one selectively-positioned, fit-adjustment element of compressible foam material defining a first surface for engagement upon an exposed surface of the liner and an opposite second surface positioned for cushioning engagement with a surface of the wearer's head. Preferably, the opposite second surface of the fit-adjustment element comprises a wicking material for drawing moisture away from the surface of the wearer's head. The industrial protective helmet further comprises a sweat band removably attached within the rigid shell and having a face surface disposed for engagement upon a surface of the wearer's brow. Preferably, the face surface of the sweat band comprises a wicking material for drawing moisture away from the surface of the wearer's brow. The industrial protective helmet further comprises a transparent peak removably attached upon an outer surface of the rigid shell in a region generally above a wearer's eyes. Preferably, the transparent peak is positioned on the rigid shell. The industrial protective helmet further comprises a front securement strap having first and second ends attached to the rigid shell and extending about a wearer's chin.

Thus, according to the present invention there is provided an improved industrial protective helmet that represents a major improvement in head protection in several different and important respects.

These and other features and advantages of the invention will be seen from the following description of a presently preferred embodiment, and from the claims.

DESCRIPTION OF THE PREFERRED EMBODIMENTS

Figure 1:
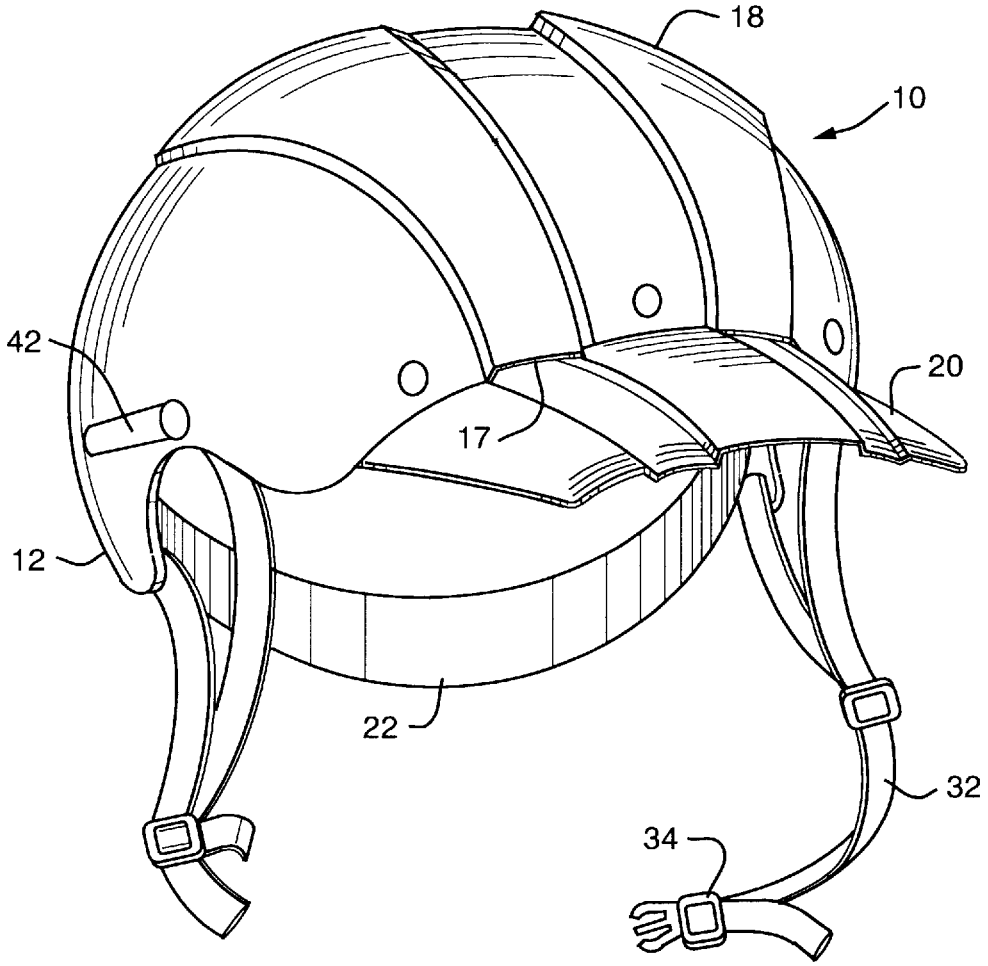
FIG. 1 is a front perspective view of a industrial protective helmet of the invention.
Figure 2:
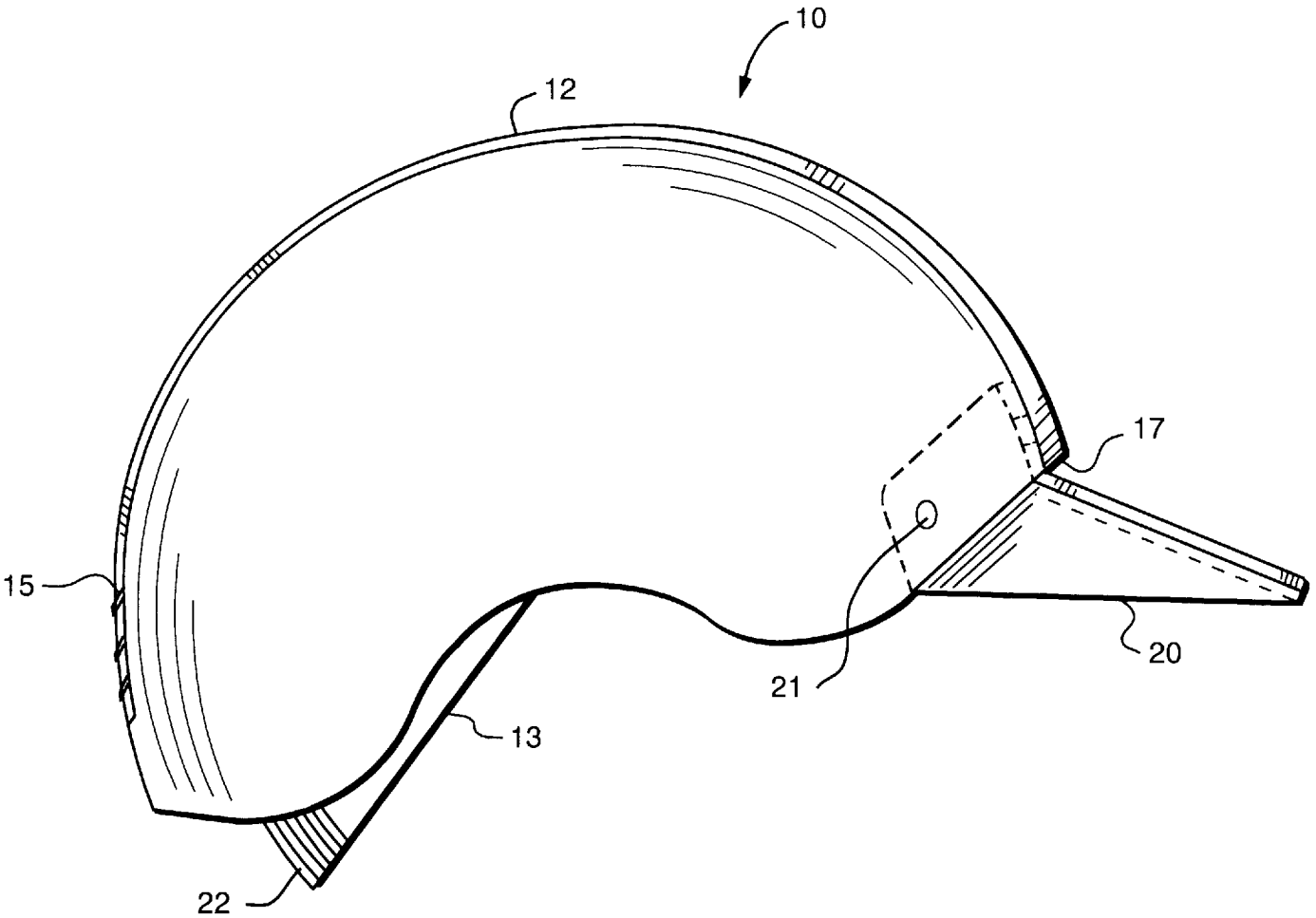
FIG. 2 is a side elevation view of the helmet of FIG. 1.
Figure 3:
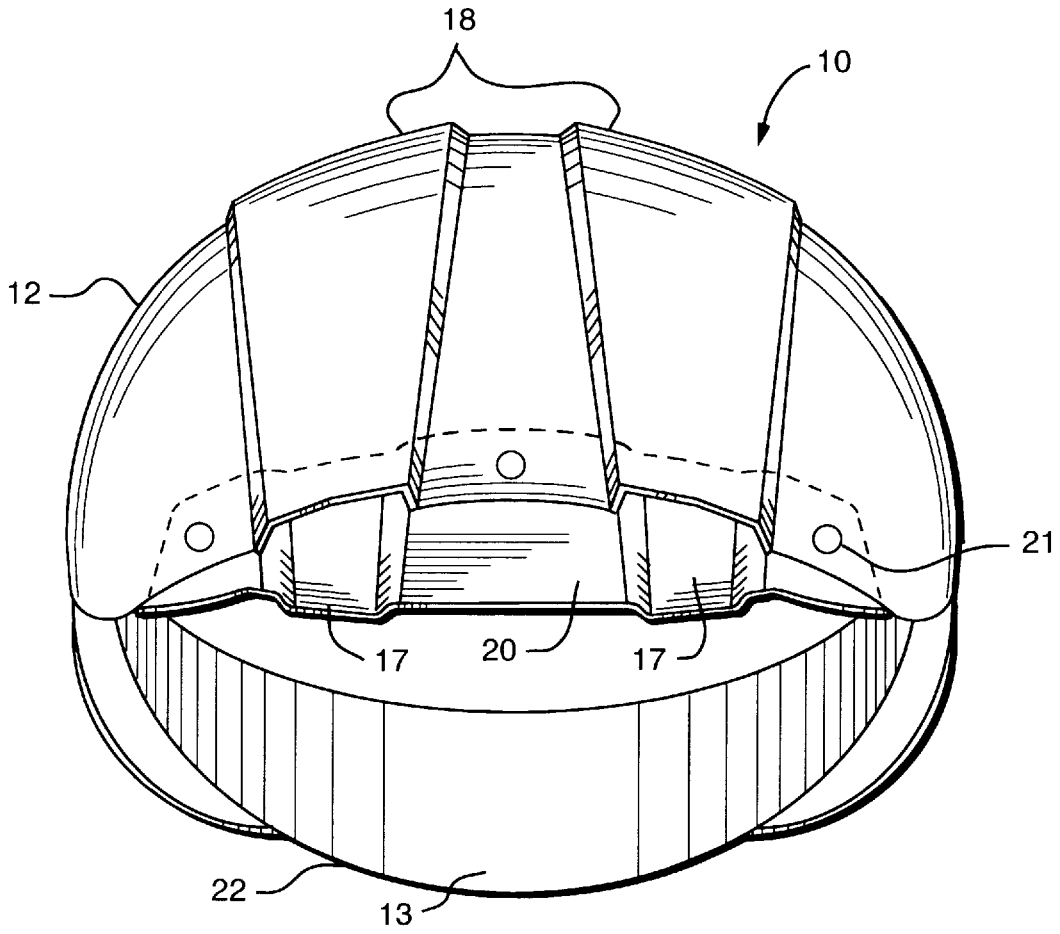
FIG. 3 is a front elevation view of the helmet of FIG. 1.

Referring to the drawings, a industrial protective helmet 10 of the invention has a rigid outer shell 12 and an inner liner 14. The protective outer shell 12 is formed by injection molding of a high density polyethylene or other suitable material. The inner liner 14 is a layer of cellular material, e.g., expanded plastic or foam, and is disposed between the inner surface of the outer shell and the surface of the wearer's head. The material of the inner liner is selected to suit the application and level of protection required for a given region of the skull.

The outer shell 12 and the inner liner 14 together define ventilation channels 18 which are open to the inside of the helmet through holes 16 in the inner liner 14, and to the outside of the helmet through openings 17, defined by the peak 20 and shell 12 at the front of the helmet. At the back of the helmet, air escapes from channels 18 through louvers 15 in the outer shell 12. An important improvement in the safety helmet of the invention is achieved by encouraging convection currents through channels 18 in a manner to induce convection air flow through the channels to better cool the wearer's head.

The inner liner 14 is installed permanently in the factory, according to safety regulations, and cannot be modified by the wearer. However, the safety helmet 10 further includes one or more adjustable cushion elements 26 of foam material that are selectively positioned by the individual wearer in a manner to customize fit of the helmet to the wearer's skull and which are removable and replaceable to permit the user to assess the condition and distribution of the cushion elements. The individualized cushion elements 26 can also increase shock absorption and facilitate ventilation. The cushion elements 26 are formed of a cushioning material, e.g., an open cell foam. Preferably the cushion elements include an adhesive backing on a first surface 25, and a second surface 27 covered with a fabric material, e.g. COOL MAX™ by E.I. duPont de Nemours & Co., of Wilmington, Del., designed to wick moisture away from, e.g., the skin or scalp.

The safety helmet 10 has a transparent peak (or visor) 20, provided to eliminate the blind spot at the upper front quadrant that is generally experienced by wearers of helmets having an opaque peak. The nature of the transparent peak 20 varies with the environment where the wearer is working, e.g., peaks are available in clear, tinted and polarized material. The sturdy, scratch-resistant peak 20 is replaceable and interchangeable, and attached with cooperating fasteners 21 provided upon the outer surface of the helmet.

The safety helmet further includes a nape strap 22 having a first segment 23 passing continuously between the rigid shell 12 and the liner 14 in the region of the wearer's forehead and a second, exposed portion 13 with a padded band that extends about the lower back of a wearer's head, just at the top of the spinal cord. The strap 22, formed of a suitable resilient material and adjustable by the wearer, is designed to hold the helmet securely on the wearer's head during most normal construction activities, including bending, leaning and climbing. The strap 22 is fabric comprising a multi-layer assembly of an open cell foam layer and an outer fabric layer, preferably fabric comprising a blend of, LYCRA™ and SPANDEX™. The adjustable fit is snug enough to require that the wearer pull the helmet onto his or her head, toward the front, after setting the strap in place at the base of the skull.

Figure 5:
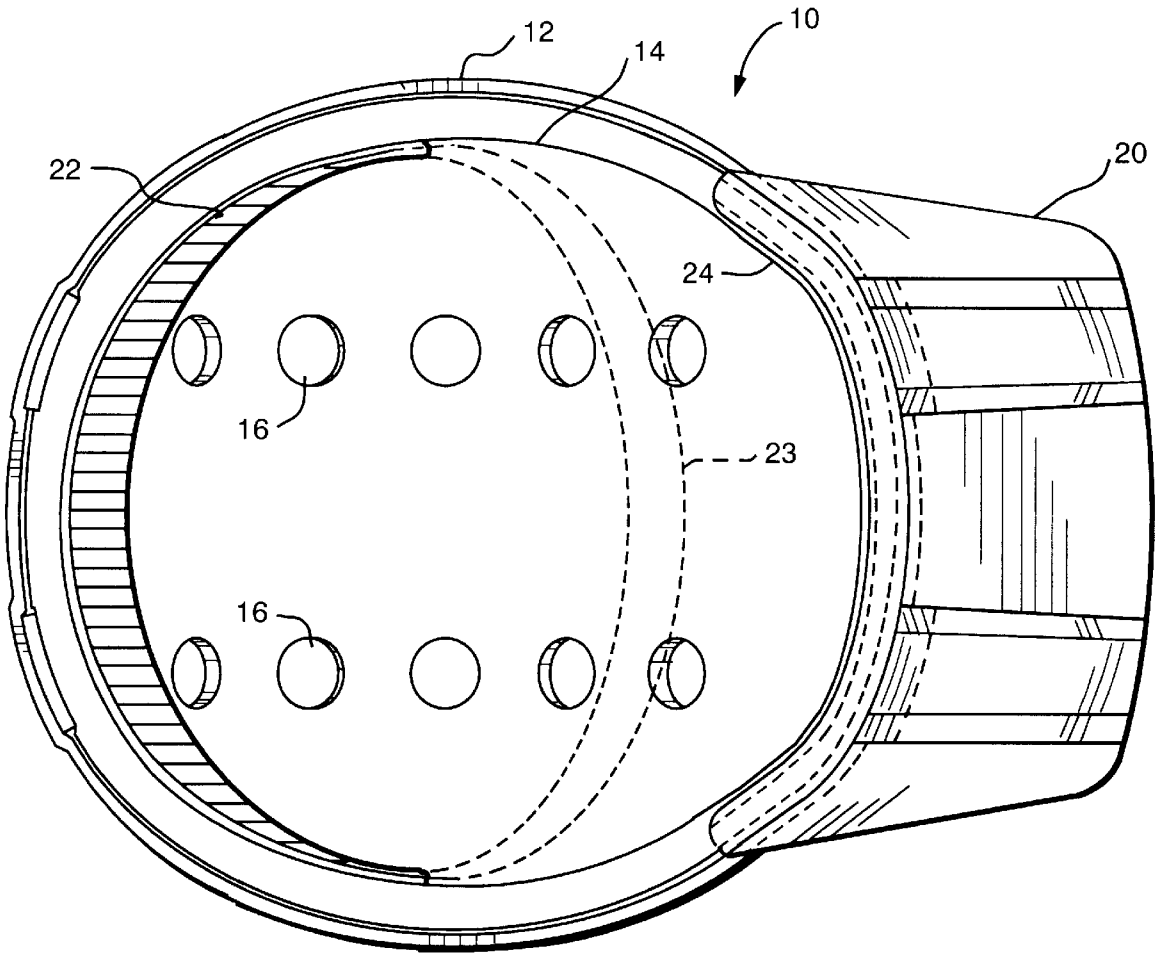
FIG. 5 is a bottom plan view of the helmet of FIG. 1.
Figure 6:
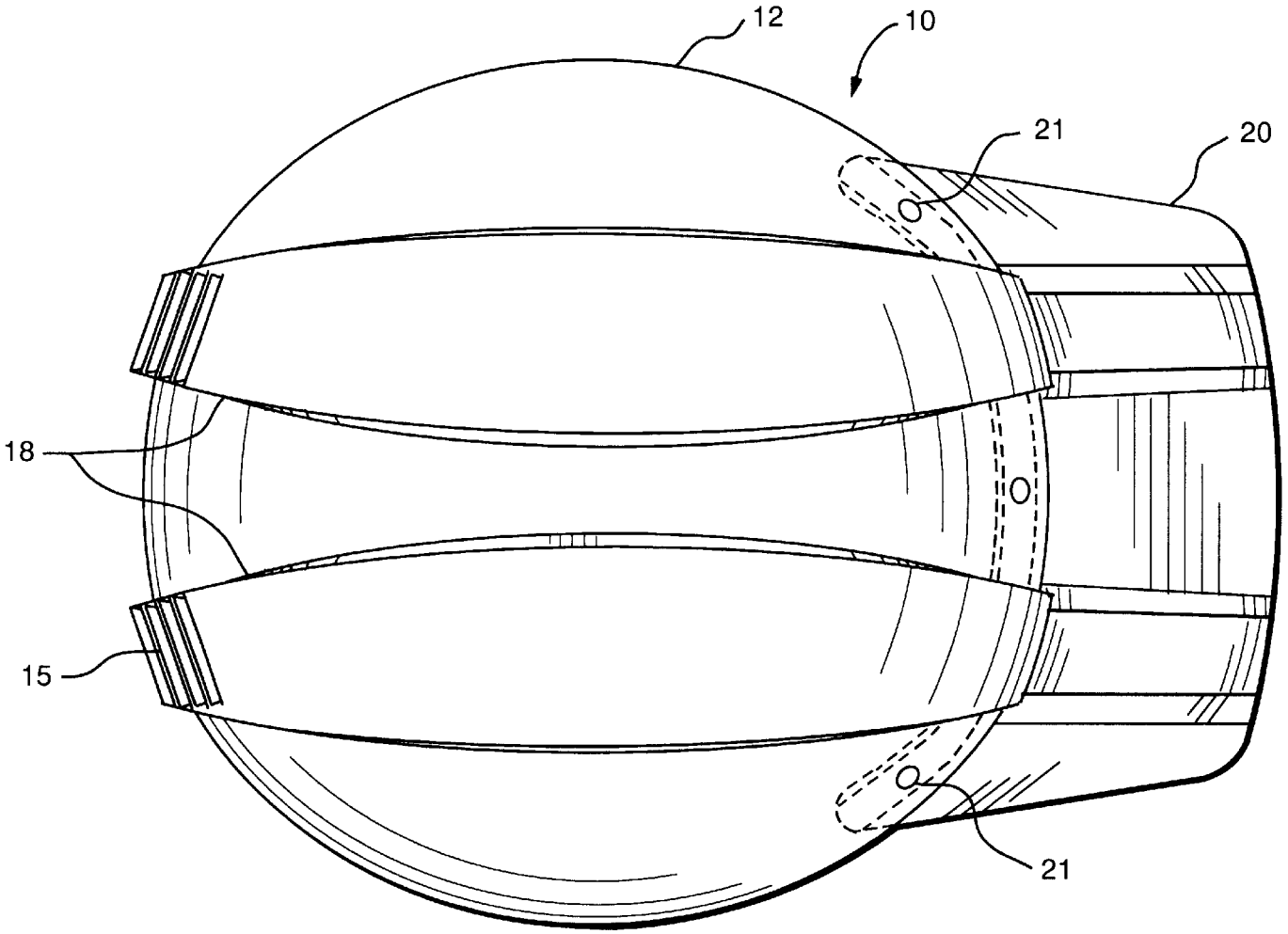
FIG. 6 is a top plan view of the helmet of FIG. 1.
Figure 7:
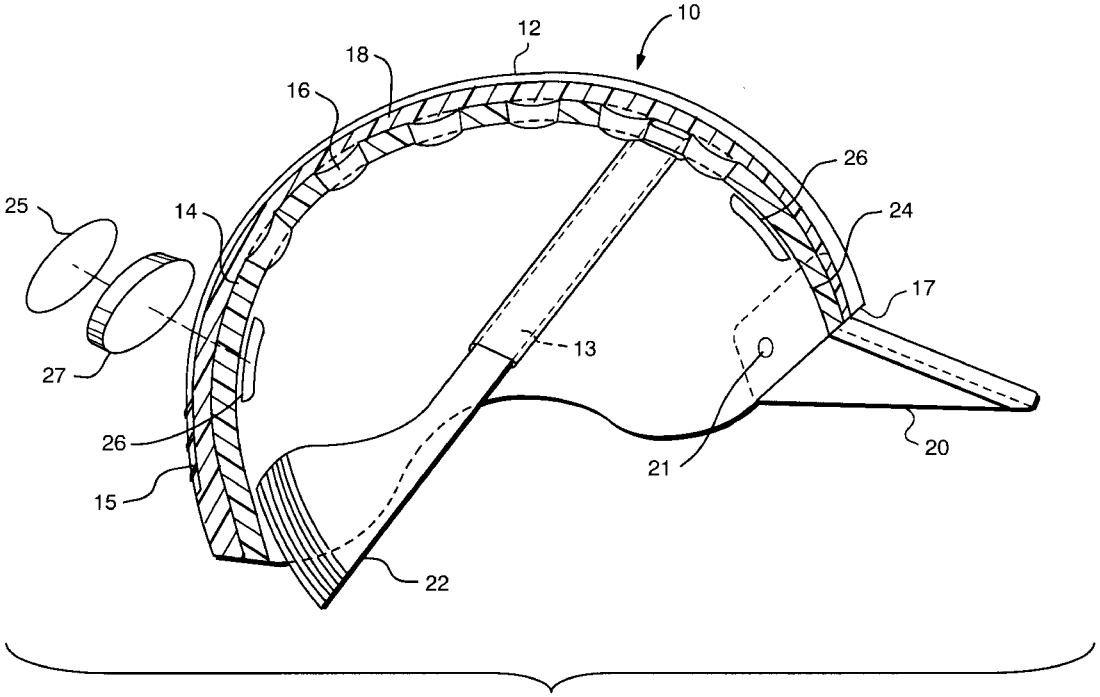
FIG. 7 is a longitudinal section taken along a vertical plane oriented along the centerline of a industrial protective helmet of the invention, from front to back.
Figure 8:
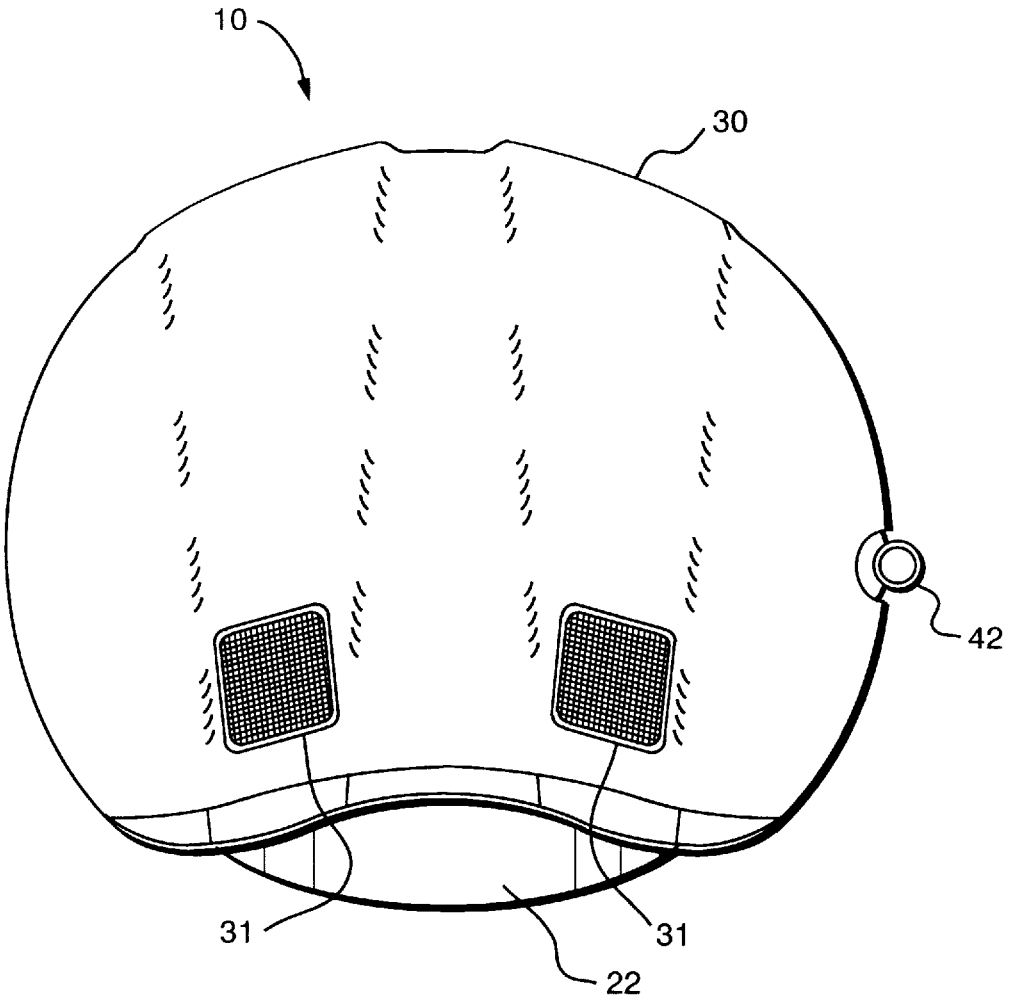
FIG. 8 is a rear elevation view of a helmet of the invention equipped with a vented fabric cover.

Referring to FIG. 5, a replaceable sweat band 24 is removably attached at the forehead region within the helmet, e.g., with a hook-and-loop type fastener arrangement such as a VELCRO® fastener. Typically, the sweat band 24 is about 5 inches long and 1¼ inches wide. The sweat band is preferably formed of a washable material, but can be inexpensive enough to permit regular replacement. The sweat bands may be provided in different colors, textures and thicknesses to allow wearers to individualize their helmets.

The nape strap 22 holds the safety helmet 10 on a wearer's head during most standard construction operations. However, when a wearer is working in very tight quarters, or for prolonged periods of inverted effort, additional security is provided by a chin strap 32 extending beneath the wearer's chin. The chin strap 32 is formed of, e.g., braided and woven nylon with a closed cell foam pad against the wearer's tender under-chin skin. The chin strap 32 is adjustable and buckles into place at the right temple with a male/female compression clasp 34 formed, e.g., of dense polyethylene or other suitable material. In a preferred embodiment, the chin strap can be used in three positions: (1) under the chin, (2) dangling free from the temple, or (3) snapped across above the transparent peak for convenient stowage. The chin strap is also removable and replaceable.

Figure 4:
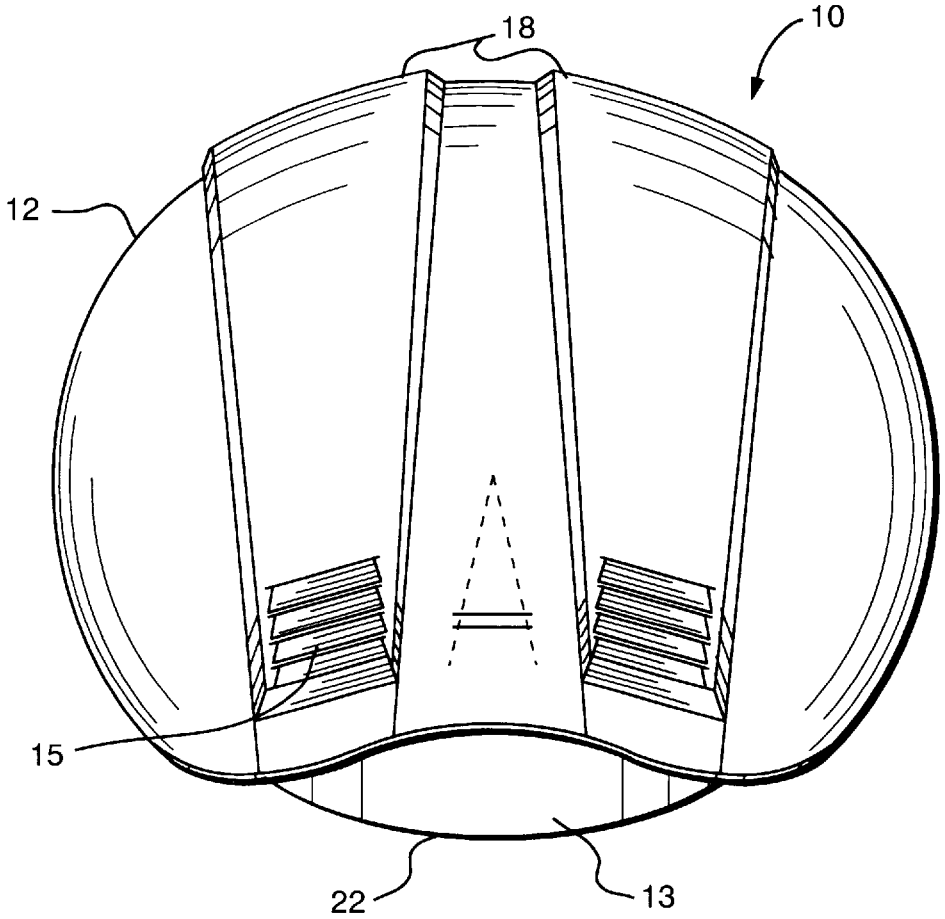
FIG. 4 is a rear elevation view of the helmet of FIG. 1.

It is to be understood that within the scope of the appended claims the invention may be practiced otherwise than as specifically described. For example, in one embodiment, the safety helmet 10 of the invention may be provided with a flexible cover 30 (FIG. 4A) to permit further individualization, e.g., a cover 30 can be provided with logos, designs, or slogans reflecting personal interests of the wearer. Preferably, the cover 30 is formed of LYCRA™ fabric or other suitable material, and defines mesh panels 31 in registration with ventilation outlets from within the rigid shell. The cover 30 provides protection for the helmet shell 12 from scratches, abrasion, dirt, oil, overspray and ultraviolet rays. Cover 30 may be light colored to keep the wearer relatively cooler under a hot sun by reflection, and/or have highly reflective panels for additional visibility during time of low light, e.g. early morning, dusk or night, for work in hazardous areas. Preferably, the material of the cover 30 is both slippery and able to rip or tear, to avoid grabbing during a skidding fall that could potentially cause a neck injury to an otherwise protected wearer. Interchangeable covers having different colors or fabrics may be used with the helmet to suit different user requirements.

What is claimed is:

1. An industrial protective helmet comprising:

a rigid outer shell extending upon a surface region of a wearer's head, including temple and skull base regions, a liner of rigid foam fixedly attached to an inner surface of said shell, at least one selectively-positioned, fit-adjustment, element of compressible foam material, said at least one selectively-positioned, fit-adjustment element defining a first surface for engagement upon an exposed surface of said liner and an opposite second surface positioned for cushioning engagement with a surface of the wearer's head, and a rear securement strap of resilient material for drawing a front portion of said helmet against the wearer's head, wherein said rear securement strap has a first segment passing continuously between the rigid shell and liner in a region at a wearer's forehead and a second, exposed portion extending rearwardly about the base of a wearer's skull.

2. The industrial protective helmet of claim 1 wherein said liner of rigid foam fixedly attached to an inner surface of said shell defines at least one passive cooling channel for passage of ventilation generally between said rigid shell and a head surface of the wearer.

3. The industrial protective helmet of claim 2 wherein said liner of rigid foam comprises a compression impact absorbing system.

4. The industrial protective helmet of claim 2 or 3 wherein said liner of rigid foam comprises relatively low density foam material.

5. The industrial protective helmet of claim 1 wherein said second surface of said at least one selectively-positioned, fit-adjustment element comprises a wicking material for drawing moisture away from the surface of the wearer's head.

6. The industrial protective helmet of claim 1 further comprising a sweat band removably attached within said rigid shell and having a face surface disposed for engagement upon a surface of the wearer's brow.

7. The industrial protective helmet of claim 6 wherein said face surface of said sweat band comprises a wicking material for drawing moisture away from the surface of the wearer's brow.

8. The industrial protective helmet of claim 1 further comprising a transparent peak removably attached upon an outer surface of said rigid shell in a region generally above a wearer's eyes.

9. The industrial protective helmet of claim 8 wherein said transparent peak is positioned on said rigid shell.

10. The industrial protective helmet of claim 8 wherein said transparent peak is clear.

11. The industrial protective helmet of claim 8 wherein said transparent peak is tinted.

12. The industrial protective helmet of claim 8 wherein said transparent peak is polarized.

13. The industrial protective helmet of claim 1 further comprising a front securement strap having a first end and a second end, each attached to said rigid shell, and extending about a wearer's chin.

14. The industrial protective helmet of claim 1 further comprising a flexible cover sized and constructed for snug attachment upon an outer surface of said rigid shell.

15. The industrial protective helmet of claim 1 wherein said flexible cover is formed of a resilient material.

16. The industrial protective helmet of claim 14 wherein said flexible cover is formed of a material selected to resist snagging or grabbing upon an engaging surface during relative movement of the flexible cover along the engaging surface.

17. An industrial protective helmet comprising:

a rigid outer shell extending upon a surface region of a wearer's head, including temple and skull base regions, a liner of rigid foam fixedly attached to an inner surface of said shell, and a rear securement strap of resilient material having a first segment passing around a region of a wearer's forehead, between the rigid shell and liner, and a second, exposed portion extending rearwardly about the base of a wearer's skull.

18. The industrial protective helmet of claim 17 wherein said liner of rigid foam fixedly attached to an inner surface of said shell defines at least one passive cooling channel for passage of ventilation generally between said rigid shell and a head surface of the wearer.

19. The industrial protective helmet of claim 17 further comprising a flexible cover sized and constructed for snug attachment upon an outer surface of said rigid shell, said flexible cover defining at least one aperture in register with a ventilation opening defined in said rigid shell.

20. The industrial protective helmet of claim 17 further comprising at least one, selectively-positioned, fit-adjustment element of compressible foam material, said at least one, selectively-positioned, fit-adjustment element defining a first surface for engagement upon an exposed surface of said liner and an opposite second surface positioned for cushioning engagement with a surface of the wearer's head.

21. The industrial protective helmet of claim 20 wherein said second surface of said at least one selectively-positioned, fit-adjustment element comprises a wicking material for drawing moisture away from the surface of the wearer's head.

22. The industrial protective helmet of claim 17 further comprising a sweat band removably attached within said rigid shell and having a face surface disposed for engagement upon a surface of the wearer's brow.

23. The industrial protective helmet of claim 22 wherein said face surface of said sweat band comprises a wicking material for drawing moisture away from the surface of the wearer's brow.

24. The industrial protective helmet of claim 17 further comprising a transparent peak removably attached upon an outer surface of said rigid shell in a region generally above a wearer's eyes.

25. The industrial protective helmet of claim 24 wherein said transparent peak is positioned on said rigid shell.

26. The industrial protective helmet of claim 17 further comprising a front securement strap having a first end and a second end, each attached to said rigid shell, and extending about a wearer's chin.

27. An industrial protective helmet comprising:

a rigid outer shell extending upon a surface region of a wearer's head, including temple and skull base regions, said rigid outer shell including at least one covered channel, having an inlet and outlet, for providing ventilation to a covered surface of the wearer's head, while impeding passage of foreign objects and sparks into the helmet, a liner of rigid foam fixedly attached to an inner surface of said shell, at least one selectively-positioned, fit-adjustment element of compressible foam material, said at least one selectively positioned, fit-adjustment element defining a first surface for engagement upon an exposed surface of said liner and an opposite second surface positioned for cushioning engagement with a surface of the wearer's head, and, further, comprising a rear securement strap of resilient material having a first segment passing continuously between the rigid shell and liner in a region at a wearer's forehead and a second exposed portion extending rearwardly about the base of a wearer's skull.

28. The industrial protective helmet of claim 27 wherein said liner of rigid foam fixedly attached to an inner surface of said shell defines at least one passive cooling channel for passage of ventilation from said channel in said rigid shell to the wearer's head.

29. The industrial protective helmet of claim 28 wherein said liner of rigid foam comprises a compression impact absorbing system.

30. The industrial protective helmet of claim 28 or 29 wherein said liner of rigid foam comprises relatively low density foam material.

31. The industrial protective helmet of claim 27 wherein said second surface of said at least one selectively-positioned, fit-adjustment element comprises a wicking material for drawing moisture away from the surface of the wearer's head.

32. The industrial protective helmet of claim 27 further comprising a sweat band removably attached within said rigid shell and having a face surface disposed for engagement upon a surface of the wearer's brow.

33. The industrial protective helmet of claim 32 wherein said face surface of said sweat band comprises a wicking material for drawing moisture away from the surface of the wearer's brow.

34. The industrial protective helmet of claim 27 further comprising a transparent peak removably attached upon an outer surface of said rigid shell in a region generally above a wearer's eyes.

35. The industrial protective helmet of claim 34 wherein said transparent peak is positioned on said rigid shell.

36. The industrial protective helmet of claim 34 wherein said transparent peak is clear.

37. The industrial protective helmet of claim 34 wherein said transparent peak is tinted.

38. The industrial protective helmet of claim 34 wherein said transparent peak is polarized.

39. The industrial protective helmet of claim 27 further comprising a front securement strap having a first end and a second end, each attached to said rigid shell, and extending about a wearer's chin.

40. The industrial protective helmet of claim 27 further comprising a flexible cover sized and constructed for snug attachment upon an outer surface of said rigid shell.

41. The industrial protective helmet of claim 40 wherein said flexible cover is formed of a resilient material.

42. The industrial protective helmet of claim 40 wherein said flexible cover is formed of a material selected to resist snagging or grabbing upon an engaging surface during relative movement of the flexible cover along the engaging surface.

43. An industrial protective helmet comprises:

a rigid outer shell extending upon a surface region of a wearer's head, including temple and skull base regions, said rigid outer shell including at least one covered channel having an inlet and outlet for providing ventilation to a covered surface of the wearer's head while impeding passage of foreign objects and sparks into the helmet, a liner of rigid foam fixedly attached to an inner surface of said shell, and a rear securement strap of resilient material having a first segment passing around a region of a wearer's forehead, between the rigid shell and liner, and a second, exposed portion extending rearwardly about the base of a wearer's skull.

44. The industrial protective helmet of claim 43 wherein said liner of rigid foam fixedly attached to an inner surface of said shell defines at least one passive cooling channel for passage of ventilation generally between said rigid shell and a head surface of the wearer.

45. The industrial protective helmet of claim 43 further comprising a flexible cover sized and constructed for snug attachment upon an outer surface of said rigid shell, said flexible cover defining at least one aperture in register with a ventilation opening defined in said rigid shell.

46. The industrial protective helmet of claim 43 further comprising at least one, selectively-positioned, fit-adjustment element of compressible foam material, said at least one, selectively-positioned, fit-adjustment element defining a first surface for engagement upon an exposed surface of said liner and an opposite second surface positioned for cushioning engagement with a surface of the wearer's head.

47. The industrial protective helmet of claim 46 wherein said second surface of said at least one selectively-positioned, fit-adjustment element comprises a wicking material for drawing moisture away from the surface of the wearer's head.

48. The industrial protective helmet of claim 43 further comprising a sweat band removably attached within said rigid shell and having a face surface disposed for engagement upon a surface of the wearer's brow.

49. The industrial protective helmet of claim 47 wherein said face surface of said sweat band comprises a wicking material for drawing moisture away from the surface of the wearer's brow.

50. The industrial protective helmet of claim 43 further comprising a transparent peak removably attached upon an outer surface of said rigid shell in a region generally above a wearer's eyes.

51. The industrial protective helmet of claim 50 wherein said transparent peak is positioned on said rigid shell.

52. The industrial protective helmet of claim 43 further comprising a front securement strap having a first end and a second end, each attached to said rigid shell, and extending about a wearer's chin.

* * * * *